United States Patent [19]

Haendle et al.

[11] Patent Number: 4,479,231

[45] Date of Patent: Oct. 23, 1984

[54] METHOD FOR THE PRODUCTION OF X-RAY IMAGES AND X-RAY TELEVISION APPARATUS FOR CARRYING OUT SAID METHOD

[75] Inventors: Joerg Haendle, Erlangen; Wolfgang Maass, Nuremberg, both of Fed. Rep. of Germany

[73] Assignee: Siemens Aktiengesellschaft, Berlin & Munich, Fed. Rep. of Germany

[21] Appl. No.: 421,282

[22] Filed: Sep. 22, 1982

[30] Foreign Application Priority Data

Oct. 15, 1981 [DE] Fed. Rep. of Germany ..... 3141041

[51] Int. Cl.[3] ..... G03B 41/16

[52] U.S. Cl. ..... 378/99; 358/111

[58] Field of Search ..... 378/99; 358/111

[56] References Cited

U.S. PATENT DOCUMENTS

| | | | |
|---|---|---|---|
| 3,229,089 | 1/1966 | Sasao | 378/99 |
| 3,904,874 | 9/1975 | Amtmann | 378/99 |
| 4,161,755 | 7/1979 | Haendle | 378/99 |

*Primary Examiner*—Craig E. Church

*Attorney, Agent, or Firm*—Hill, Van Santen, Steadman & Simpson

[57] ABSTRACT

The disclosure proceeds from the fact that, even in the case of the most painstaking selection of the hardness of X-rays employed for the purpose of irradiation of heterogenously composed specimens, such as, for example, body parts interspersed with bones, no video image which is entirely satisfactory in all parts is obtained. An image is desirable in which the fine contrasts of soft parts appear just as clearly as those of parts which, such as bones, for example, strongly absorb X-rays. To this end the disclosure provides that image signals, which are generated with X-rays of various hardnesses; for example, such of more than 100 kV and such of less than 60 kV, be stored, and that therefrom the respectively favorably represented surface elements be joined together to form a resultant image. The disclosed embodiment is particularly suited for use in medical X-ray diagnostics.

4 Claims, 6 Drawing Figures

METHOD FOR THE PRODUCTION OF X-RAY IMAGES AND X-RAY TELEVISION APPARATUS FOR CARRYING OUT SAID METHOD

BACKGROUND OF THE INVENTION

The invention relates to the production of X-ray images utilizing fluoroscopy apparatus with a radiation source which alternately emits X-radiation produced with a high X-ray tube voltage and with a low X-ray tube voltage, and an X-ray image intensifier television chain which includes an X-ray image intensifier, a video camera, and a video display unit, with the video camera supplying respective first and second image signals resulting respectively from X-radiation produced with the high tube voltage and produced with the low tube voltage. Such an installation is known, for example from U.S. Pat. No. 3,229,089.

The constrast range of X-ray television images or other electronic X-ray images to be rendered visible on a television display unit is less than in the case of records with X-ray films. In the case of images with soft X-radiation, contrasts of soft parts, i.e. details absorbing X-rays only little, are well represented. Fine contrasts of locations which are penetrable with difficulty for X-rays, for example such in the region of bone shadows, therefore, become lost. On the other hand, with hard X-radiation, soft parts are irradiated without significant absorption and result in surface elements which appear structurelessly white in the image. Hard ray fluoroscopy images of bones, however, appear clear and contrasty. Therefore, also a careful selection of the hardness of the rays employed for the image in the case of a heterogenously composed specimen, such as e.g. a human body to be examined represents, as a rule, does not lead to any television image which is fully satisfactory in all parts.

In order to overcome the above-cited disadvantage, an X-ray imaging system has become known from U.S. Pat. No. 3,229,089 which contains means for generating coincident X-rays of different wavelengths with which a sample is irradiated alternately and repetitively. Moreover, means for the conversion of the X-ray images into a light image are provided, whereby the conversion takes placed in a television pickup-and-display arrangement which produces color images. In the color image a specific color is associated with each X-ray hardness. Moreover, the sequence of the images of different colors, i.e. hardness, is so controlled that no resolution is possible any longer by the eye. Accordingly, as the sum image such an image appears in which the details appear in different colors. However, an arrangement of this type has not yet been able to be successful in X-ray examination technology because no reality is attributed to the different colors. Moreover, the outlay is very great on account of the required synchronization.

SUMMARY OF THE INVENTION

The object underlying the invention, resides in disclosing and providing the possibility of uniting in one image the fine contrasts of the soft parts, which are obtained by means of soft radiation, and the fine contrasts of parts which, for example like bones, strongly absorb X-rays, with hard radiation.

In accordance with the invention, it is possible to synthesize an X-ray image in an X-ray television apparatus from parts in which the fine contrasts, which originate from soft parts, are produced by means of soft X-rays, and contrasts which originate from strongly absorbing parts, are produced by means of hard X-rays. To this end, two X-ray television images are produced by means of memory technology, of which one is made with hard radiation and one is made with soft radiation. These images are stored in two electronic memories. For the separation of the details in the images and for the generation of image parts wich can be combined to form a resultant image, a characteristics curve limitation, i.e. a limitation of the amplitudes of the image signals to be further transmitted, takes place. Finally, the image regions of optimum detail contrast are added, so that a resultant image of optimum recognizability is obtained.

In one exemplary embodiment of the invention e.g. for the production of a fluoroscopy image, an electronic X-ray image with a high tube voltage, i.e. in particular more than 100 kV, is taken and electronically stored. Subsequently, the tube voltage is switched over to lower values, for example such of less than 60 kV, and a record is made which is written into an additional memory likewise in the form of an electronic image. The two records can be taken in direct succession, for example within a time interval of 80 to 100 ms, so that virtually the same conditions are reproduced. Of the images present in the two memories, the respective output signal is limited by means of threshold value circuits, given corresponding amplitude values, and the signals remaining thereafter are brought together in an addition amplifier. On the display unit, video monitor, an X-ray image then appears which exhibits good fine contrasts in the soft parts (bright image locations) as well as in the dark image locations. The changeover locations, which result due to the threshold value circuits, must be obliterated, for example by means of a corresponding low pass filtering. If obliteration were not carried out, the disadvantage could arise that the resultant image would exhibit irregular transitions. In an expedient fashion, the circuit technology (memories, etc.) proceeds in digital technique.

In another embodiment of the invention the signals can be provided with a correspondingly altered characteristic curve before or after the memory, respectively. Through the addition of the images a resulting characteristic curve is obtained which lies between those with soft ($\mu 1$) radiation and hard radiation ($\mu 2$). The signal dynamic range of a hard ray/soft ray record can be expanded e.g. by a factor of two, i.e. doubled.

Through the utilization of threshold value stages e.g. a signal component, compressed during the soft ray recording (flat characteristic curve portion, or dark image region, respectively) is separated before the storage proceeds. Then, with the remaining signal component, the memory can be fully modulated (the amplitude range of the memory fully utilized). With the hard ray recording, that particular component is separated from the signal by means of the threshold value stage, which component lies above a specific intensity or amplitude. With the remaining signal component the second memory is fully modulated. Via an intermediate amplification the memory signals are added in analog or digital fashion. The resulting signal may lead to an amplitude resolution of nine bits, for example. Via a window circuit, known per se, with a selectable amplitude range e.g. the image can be displayed on a monitor, or it can be reproduced in its entirety directly on a hard copy recording unit.

Further details and advantages shall be explained in the following on the basis of the exemplary embodiments illustrated in the Figures on the accompanying drawing sheets; and other objects, features and advantages will be apparent from this detailed disclosure and from the appended claims.

DETAILED DESCRIPTION

Figure 1:
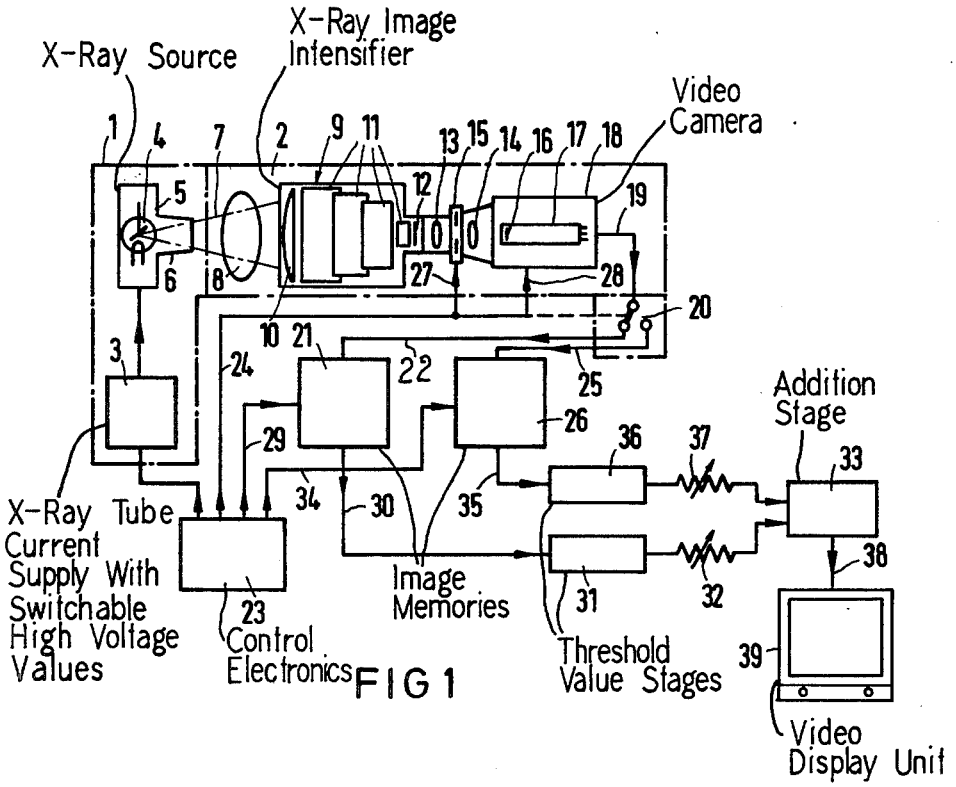
In FIG. 1, in a schematic block circuit diagram, an exemplary embodiment of the invention is illustrated in which threshold value stages are employed.

In FIG. 1, 1 designates an X-ray apparatus and 2 designates an X-ray television pickup installation. Pertaining to the X-ray apparatus 1 is a current supply device 3 with which an X-ray tube 4 is supplied which is disposed in a radiator housing 5 at the output of which a diaphragm tube body 6 is disposed which delimits the desired cross section of a radiation beam 7 with which a body 8 is irradiated.

The shadow image, produced by the body 8 by means of the beam 7, then strikes an image intensifier 9 in which, first, in an inlet screen 10, the conversion of the X-rays into electrons proceeds, which then, by means of electron optics 11, are imaged on an outlet screen 12. The light image appearing there is then imaged, via a first optics 13 and a second optics 14, between which a diaphragm 15 is disposed, on the inlet screen 16 of a video pickup tube 17 which is disposed in a video camera 18.

The generated video signal can then be removed via a line 19 and, in the illustrated position of a switch 20, it can be supplied to a memory 21 via a line 22. If, by means of control electronics 23 associated with the current supply part 3 of the X-ray apparatus 1, an alteration of the radiation hardness radiated by the tube 4 is effected, then the switch 20 is simultaneously switched over via a line 24 so that a connection takes place with a line 25 and hence with a memory 26. Moreover, as indicated by arrows 27 and 28, also an alteration of the diaphragm 15 and of the operating values of the video camera 18 is effected from the control electronics 23.

After reception of an image with hard radiation in the memory 21 and of an image with soft radiation in the memory 26, by means of the control electronics 23, via a switching line 29, the output of the image present in the memory 21 takes place via a line 30, which leads via a threshold value stage 31 and an adjustable resistance 32, to an addition stage 33. On the other hand, the control electronics can then, via a line 34, also recall the image from the other memory 26 so that, via a line 35 and a threshold value stage 36 as well as a variable resistance 37, a connection to the addition stage 33 is likewise obtained. The resultant signal from the addition stage 33 is then supplied via a line 38 to a monitor 39 on which the X-ray image is rendered visible.

Figure 2:
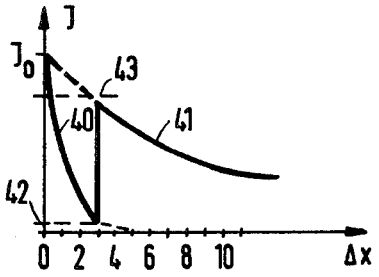
In FIG. 2, in a diagram, the switching over of a characteristic curve in the case of a specific threshold value is illustrated.
Figure 3:
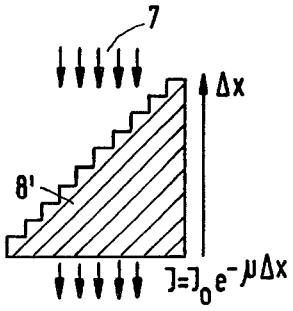
In FIG. 3, the irradiated body employed for deriving the illustration according to FIG. 2 is illustrated in section.
Figure 4:
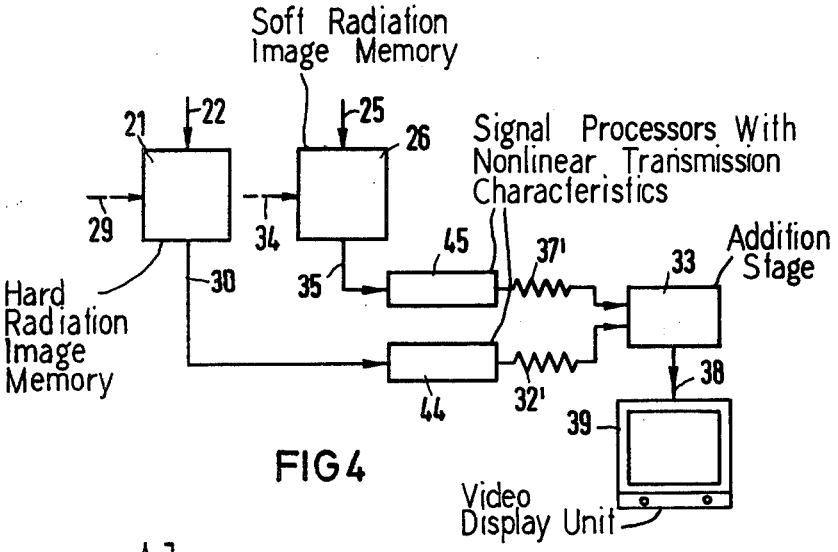
In FIG. 4, the block circuit diagram of a modification of the image display part of FIG. 1 is illustrated.

In FIG. 2, in a diagram, the radiation intensities J, passing through the body 8' of FIG. 3 from the beam 7 of the intensity $J_o$, are plotted on the ordinate relative to the increasing thickness $\Delta x$ of the body 8' on the abscissa. In utilizing soft rays, if one disregards the steps, the curve 40 would have to result and, for the utilization of hard rays, the curve 41, of which the former drops off more rapidly than the second as a function of thickness. Regarding a switching over from the one characteristic curve 40 to the characteristic curve 41, the lower limit 42 is provided, and in the counter direction from the curve 41 to the curve 40, the intensity which is indicated by broken line 43 provides a switchover point. The switch-over points corresponding to the lines 42 and 43 are provided by the threshold value stages 31 and 36.

Figure 5:
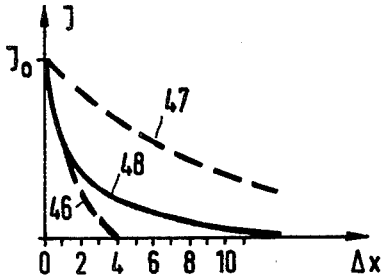
In FIG. 5, in a diagram, the resulting characteristic curve attainable through switching-over the characteristic curve with a device according to FIG. 4 is illustrated; and In FIG. 6, the schematic block circuit diagram of a further modification of the image registration part of FIG. 1 illustrated.

For the processing of the signals which are read out from the memories 21 and 26, also characteristic curve-alteration devices 44 and 45 can be provided which are connected via resistances 32' and 37' with the addition stage 33. As is illustrated in FIG. 5, the two characteristic curves 46 and 47 can be selected (at devices 44 and 45), which are then combined at the addition stage 33 into the resulting characteristic curve 48 which lies between the two characteristic curves 46 and 47.

Figure 6:
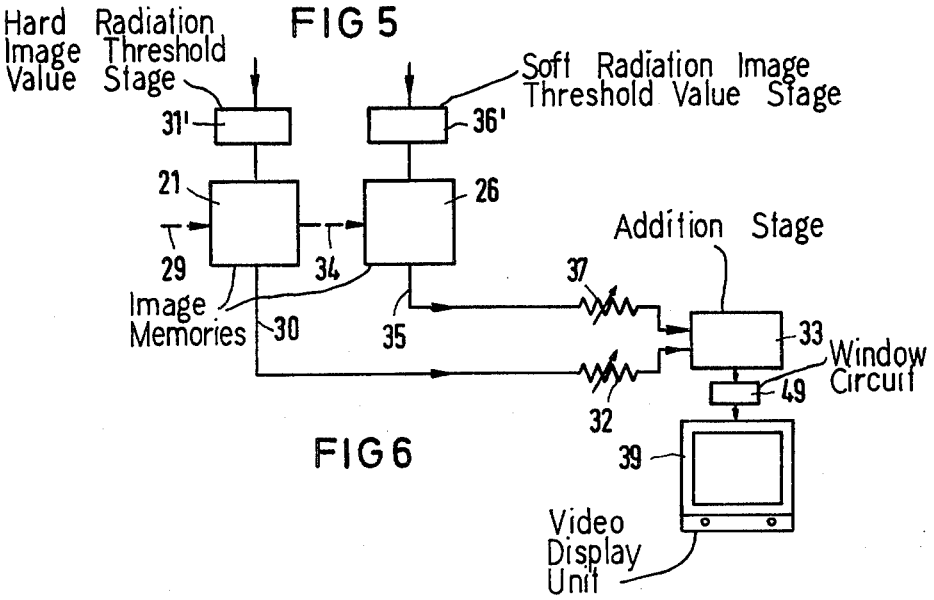

In the arrangement according to FIG. 6, the threshold value stages are referenced with 31' and 36' and are series connected with the memories 21 and 26. Representing a further difference with FIG. 1 is a window circuit 49 which is disposed between the adder 33 and the monitor 39. The method of operation of this arrangement corresponds to that which is disclosed at the end of the section hereof entitled Summary of the Invention.

It will be apparent that many modifications and variations may be made without departing from the scope of the teachings and concepts of the present invention.

I claim as my invention:

1. An X-ray diagnostic installation comprising a fluoroscopy apparatus with a radiation source which alternately emits X-radiation produced with a high tube voltage and with a low tube voltage, and an X-ray image intensifier television chain which includes an X-ray image intensifier, a video camera, and a video display unit, said video camera supplying respective first and second image signals resulting respectively from X-radiation produced with the high tube voltage and produced with the low tube voltage, first and second image memories for storing respective first and second images, a switch for alternately connecting said video camera with said first and second image memories such that said first image memory stores a first image resulting from X-radiation produced with the high tube voltage and such that said second image memory stores a second image resulting from X-radiation produced with the low tube voltage, and first and second threshold value circuits connected between the first and second image memories, respectively, and the video display unit, said first and second threshold value circuits having first and second threshold values and supplying to the video display unit only those portions of the first image which fall below the first threshold and only those portions of the second image which exceed the second threshold to produce a resultant image on the video display unit.

2. An X-ray diagnostic installation according to claim 1, characterized in that an addition stage is connected between the threshold value circuits and the video display unit.

3. An X-ray diagnostic installation according to claim 2, characterized in that a low pass filter is connected to the addition stage.

4. An X-ray diagnostic installation comprising a fluoroscopy apparatus with a radiation source which alternately emits X-radiation produced with a high tube voltage and with a low tube voltage, and an X-ray image intensifier television chain which includes an X-ray image intensifier, a video camera, and a video display unit, said video camera supplying respective first and second image signals resulting respectively from X-radiation produced with the high tube voltage and produced with the low tube voltage, first and second threshold value circuits, a switch for alternately supplying said first image from the video camera to the first threshold value circuit and said second image from the video camera to the second threshold value circuit, first and second image memories connected respectively with said first and second threshold value circuits, said first threshold value circuit having a first threshold value such that the first image memory stores only those portions of the first image which fall below the first threshold value, and said second threshold value circuit having a second threshold value such that only those portions of the second image which exceed the second threshold value are stored by said second image memory, the first and second image memories having outputs connected with said video display unit for producing a resultant image at the video display unit.

* * * * *